US009032836B2

(12) United States Patent
Min et al.

(10) Patent No.: US 9,032,836 B2
(45) Date of Patent: May 19, 2015

(54) DEVICE FOR PREVENTING INWARD SHIFTING OF BRAKE PEDAL DURING COLLISION

(71) Applicants: Hyundai Motor Company, Seoul (KR); Kia Motors Corporation, Seoul (KR); Kyung Chang Industrial Co., Ltd., Daegu (KR)

(72) Inventors: Jeong Seon Min, Hwaseong-si (KR); Eun Sik Kim, Daegu (KR); Yang Rae Cho, Hwaseong-si (KR); Sung Il Byun, Daegu (KR)

(73) Assignees: Hyundai Motor Company, Seoul (KR); KIA Motors Corp., Seoul (KR); Kyung Chang Industrial Co., Ltd., Daegu (KR)

( * ) Notice: Subject to any disclaimer, the term of this patent is extended or adjusted under 35 U.S.C. 154(b) by 0 days.

(21) Appl. No.: 13/914,018

(22) Filed: Jun. 10, 2013

(65) Prior Publication Data

US 2014/0060238 A1 Mar. 6, 2014

(30) Foreign Application Priority Data

Aug. 30, 2012 (KR) ..... 10-2012-0095900

(51) Int. Cl.
*G05G 1/327* (2008.04)

(52) U.S. Cl.
CPC ..... *G05G 1/327* (2013.01); *Y10T 74/20528* (2015.01)

(58) Field of Classification Search
CPC ..... B60T 7/065; B60T 7/06; G05G 1/327; G05G 1/30; G05G 1/44; G05G 1/46; B60R 21/09
USPC ..... 74/512–514, 560; 180/274–278, 281, 180/271; 280/784
See application file for complete search history.

(56) References Cited

U.S. PATENT DOCUMENTS 5,983,746 A * 11/1999 Nawata et al. ..... 74/512
6,006,626 A * 12/1999 Notake et al. ..... 74/512
6,612,200 B1 * 9/2003 Rixon ..... 74/560

(Continued)

FOREIGN PATENT DOCUMENTS

DE 102010025568 A1 * 12/2011
JP 2008-077150 A 4/2008

(Continued)

OTHER PUBLICATIONS

Korean Office Action issued in Korean Application No. 10-2012-0095900 dated Oct. 17, 2013, 4 pgs.

*Primary Examiner* — Daniel Yabut
(74) *Attorney, Agent, or Firm* — McDermott Will & Emery LLP

(57) ABSTRACT

A device for preventing an inward shifting of a brake pedal during a collision. The device includes a mounting bracket. A pedal housing is combined with the mounting bracket such that the pedal housing is movable in a rearwards direction from the mounting bracket. A pedal arm is hinge-coupled at upper and middle parts thereof with the pedal housing and a push rod, respectively. A unit for preventing the inward shifting of the pedal arm has a separating plate which, as the pedal housing is moved rearwards, presses against a fixing pin to decouple the fixing pin from the pedal arm, enabling the pedal arm to turn outwards about a hinge point at the middle part.

5 Claims, 7 Drawing Sheets

(56) References Cited

U.S. PATENT DOCUMENTS

| | | | | |
|---|---|---|---|---|
| 6,752,038 | B2 * | 6/2004 | Cordero | 74/512 |
| 6,840,131 | B2 * | 1/2005 | Matsumoto et al. | 74/512 |
| 6,918,319 | B2 * | 7/2005 | Burgstaler et al. | 74/560 |
| 7,066,047 | B2 * | 6/2006 | Amano et al. | 74/512 |
| 7,261,015 | B2 * | 8/2007 | Williams et al. | 74/512 |
| 2008/0006119 | A1 * | 1/2008 | Tokumo et al. | 74/560 |
| 2010/0043592 | A1 * | 2/2010 | Johansson | 74/560 |

FOREIGN PATENT DOCUMENTS

| | | | |
|---|---|---|---|
| KR | 1020050046132 | A | 5/2005 |
| KR | 10-2005-0115418 | A | 12/2005 |
| KR | 10-2007-0049857 | A | 5/2007 |
| KR | 1020100135174 | A | 12/2010 |
| KR | 1020120062562 | A | 6/2012 |

* cited by examiner

DEVICE FOR PREVENTING INWARD SHIFTING OF BRAKE PEDAL DURING COLLISION

CROSS-REFERENCE TO RELATED APPLICATION

This application claims under 35 U.S.C. §119(a) the benefit of Korean Patent Application No. 10-2012-0095900 filed on Aug. 30, 2012, the entire contents of which is incorporated herein by reference.

BACKGROUND OF THE DISCLOSURE

1. Field of the Disclosure

The present disclosure relates, in general, to a device for preventing the inward shifting of a brake pedal during a collision, and more particularly, to a device in which, during a forward vehicle collision, a hinge point of a pedal arm can be disconnected by an impact force to allow the pedal arm to turn in an outward direction, thereby preventing the inward shifting of the brake pedal during the collision, and thus preventing or reducing the risk of a driver from sustaining injuries.

2. Description of the Related Art

Generally, a brake system for a vehicle is a device that is used to make a moving vehicle slow down or stop, or prevents a stationary vehicle from moving.

The brake system includes a brake pedal on which a driver steps when trying to stop a vehicle, a brake booster which uses a vacuum to increase a braking force applied by the driver to the brake pedal when the driver steps on the brake pedal, a master cylinder which acts with the brake booster to apply a higher hydraulic pressure to the brakes, and a brake assembly which brakes the wheels of a vehicle using the hydraulic pressure outputted from the master cylinder.

The brake pedal is located at the center of the driver side floorboard under the dashboard, so that the driver can operate the brake pedal quickly and safely if needed.

As shown in FIG. 1, the brake pedal is configured such that an upper end of a pedal arm 1 is hinge-coupled via a pin 4 to a mounting bracket 3 attached to a dash panel 2, and a brake booster 5 attached to the outside of the dash panel 2 is hinge-coupled to the pedal arm 1 via a rod 6, so that when a driver steps on the pedal arm 1, the brake booster 5 is actuated via the rod 6 to perform a braking operation.

Meanwhile, in the event of a forward vehicle collision, if the impact force is excessive, an engine and thus the dash panel can be forcedly moved toward the driver, together with the brake pedal and the brake booster.

At the time of a forward vehicle collision, normally the driver applies his maximum stepping power to the brake pedal. In this case, the impact force is transmitted wholly to the driver's foot and leg via the brake pedal that is being shifted towards the driver, increasing the risk of injury to the driver.

The above-description of the related art is provided only for understanding the background of the disclosure, and should not be construed as admitted prior art.

SUMMARY OF THE DISCLOSURE

Accordingly, the present disclosure has been made keeping in mind the above problems occurring in the related art, and the present disclosure is intended to propose a device in which, during a forward vehicle collision, a hinge point of a pedal arm can be disconnected by an impact force to allow the pedal arm to turn in an outward direction, thereby preventing the inward shifting of the brake pedal during the collision, and thus preventing or reducing the risk of a driver from sustaining injuries.

In order to achieve the above object, according to one aspect of the present disclosure, there is provided a device for preventing an inward shifting of a brake pedal during a collision, the device including: a mounting bracket attached to an inside of a dash panel; a pedal housing combined with the mounting bracket such that the pedal housing is movable rearwards from the mounting bracket; a pedal arm having an upper part hinge-coupled with the pedal housing via a fixing pin, and a middle part hinge-coupled with a push rod at a hinge point, the pedal arm being configured to move the push rod back and forth while turning about the fixing pin; and a unit for preventing the inward shifting of the pedal arm, the unit having a separating plate fitted into the fixing pin and configured such that as the pedal housing is moved rearwards at the time of a vehicle collision, the separating plate presses against the fixing pin to decouple the fixing pin from the pedal arm, enabling the pedal arm to turn outwards about the hinge point at the middle part.

The unit for preventing the inward shifting of the pedal arm may further include: a hinge shaft attached to the upper part of the pedal arm, wherein the fixing pin includes a pair of fixing pins fitted into opposite sides of the hinge shaft through the pedal housing and each of the pair of fixing pins having a slit end towards the hinge shaft, wherein the separating plate includes a pair of separating plates each having an inclined side that is fitted into the slit end of a corresponding fixing pin; and a pair of turn plates rotatably hinge-coupled at respective hinge points to opposite sides of the pedal housing, each of the pair of turn plates having opposite ends fitted through a corresponding separating plate and the mounting bracket, respectively, such that when the pedal housing is moved rearwards, the pair of turn plates turn about the respective hinge points to allow the inclined sides of the corresponding separating plates to press against the corresponding fixing pins.

An auxiliary hinge shaft may be disposed in the hinge shaft, wherein the pair of fixing pins are fitted into opposite sides of the auxiliary hinge shaft.

The mounting bracket may be provided at a lower end thereof with a sliding hole, and the pedal housing is provided on an upper portion thereof with a fixing hole corresponding to the sliding hole, wherein a bolt is screwed into a nut through the sliding hole and the fixing hole.

The pedal arm hinge-coupled with the push rod may be a pedal arm provided to a brake pedal.

The pedal arm hinge-coupled with the push rod may be a pedal arm provided to a clutch pedal.

According to the present disclosure, when a brake pedal is shifted inwards by the inward shift of an engine during a forward vehicle collision, a pedal arm that is hinge-pivoted about a hinge point relative to a pedal housing can be decoupled from the hinge point such that the pedal arm is allowed to turn outwards, thereby having the effect of preventing or reducing the risk of a driver from sustaining injuries.

Further, a unit for preventing the inward shifting of a pedal arm may simply be mounted to a pedal housing only at a position where it is hinge-coupled, thereby facilitating installation without having a significant impact upon a surrounding layout of a brake system. Furthermore, the unit may have a structure that is capable of minimizing the amount of inward shift of a pedal when a dash panel is shifted inwards during a vehicle collision, thereby contributing to an improvement in collision performance and therefore increasing the commercial value of a product.

BRIEF DESCRIPTION OF THE DRAWINGS

The above and other objects, features and advantages of the present disclosure will be more clearly understood from the following detailed description when taken in conjunction with the accompanying drawings, in which.

DETAILED DESCRIPTION OF THE DISCLOSURE

Figure 1:
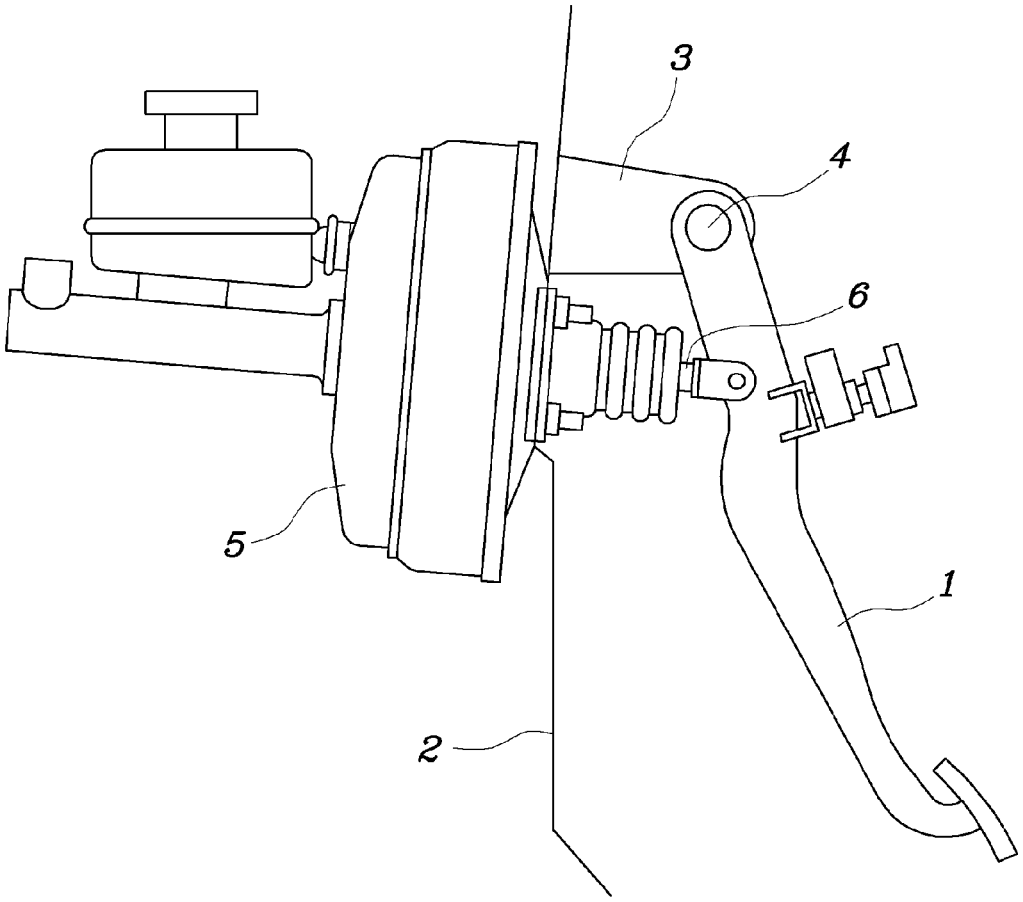
FIG. 1 is a view of a related brake system.

Reference will now be made in greater detail to a preferred, exemplary embodiment of the disclosure, an example of which is illustrated in the accompanying drawings. Wherever possible, the same reference numerals will be used throughout the drawings and the description to refer to the same or like parts.

As shown in FIGS. 2 to 6C, a device for preventing the inward shifting of a brake pedal during a collision includes a mounting bracket 20 which is attached to the inside of a dash panel 10. A pedal housing 30 is combined with the mounting bracket 20 such that the pedal housing 30 is movable rearwardly from the mounting bracket 20. A pedal arm 40 is provided such that an upper part thereof is hinge-coupled to the pedal housing 30 via a fixing pin 32, and a middle part thereof is hinge-coupled with a push rod 52 at a hinge point. The pedal arm 40 is configured to move the push rod 52 back and forth while turning about the fixing pin 32. A unit for preventing the inward shifting of the pedal arm 40 has a separating plate 34 which is fitted into the fixing pin 32 such that, as the pedal housing 30 is moved rearward at the time of a vehicle collision, the separating plate 34 presses against the fixing pin 32 to decouple it from the pedal arm 40, enabling the pedal arm 40 to turn outwards about the hinge point at the middle part.

The rearward direction of the mounting bracket 20 indicates the rearward direction of a vehicle, that is, the inward direction towards the interior of a vehicle from the dash panel 10.

When an engine and therefore the dash panel 10 are sequentially shifted inwards towards the interior of a vehicle during a forward vehicle collision, the pedal housing 30 is also shifted inwards. Here, the fixing pin 32 can be decoupled from the pedal arm 40, so that the pedal arm 40 which was hinge-coupled to the upper portion of the pedal housing 30 can be decoupled from the pedal housing 30. Accordingly, the pedal arm 40 can turn outwards (e.g., in the reverse direction away from the interior of the vehicle) about the hinge point at which an end of the push rod 52 is hinge-coupled, thereby making it possible to prevent the driver's foot, which is stepping on the pedal, from being injured.

Figure 4:
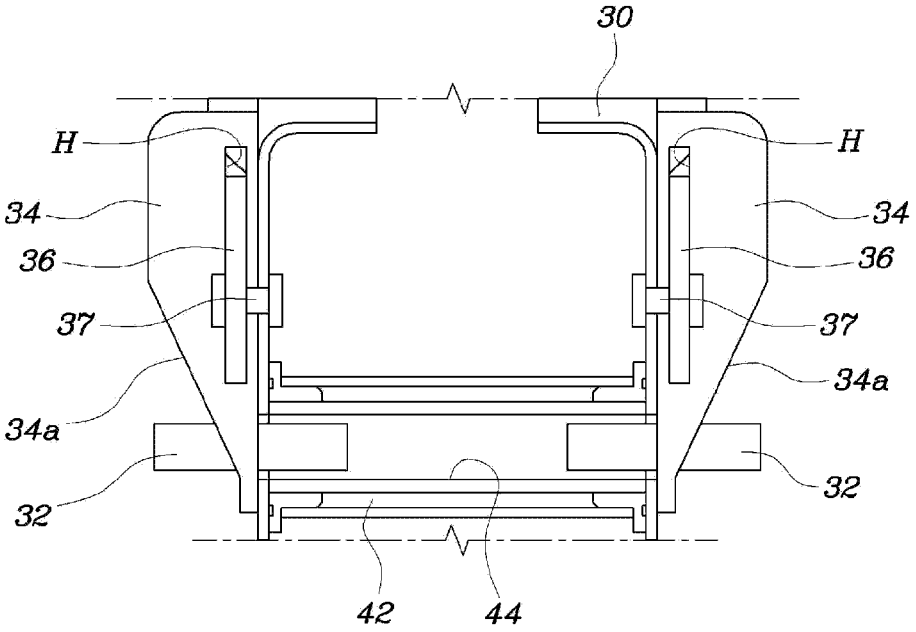
FIG. 4 is a view of an exemplary unit for preventing the inward shifting of a pedal arm according to the present disclosure, in a state in which a vehicle collision has not occurred.
Figure 5:
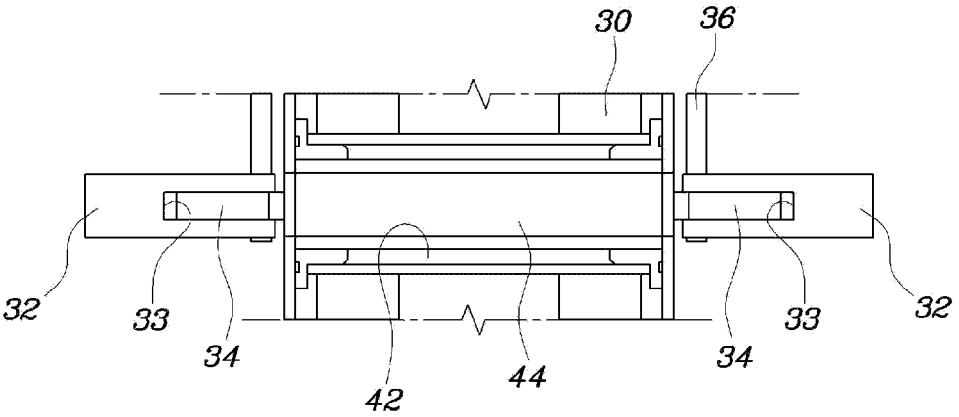
FIG. 5 is a view of the exemplary unit for preventing the inward shifting of the pedal arm according to the present disclosure, in a state in which a vehicle collision has occurred.

As shown in FIGS. 4 and 5, the unit for preventing the inward shifting of the pedal arm 40 further includes a hinge shaft 42 which is attached to the upper part of the pedal arm 40, and a pair of turn plates 36 which are rotatably hinge-coupled at their hinge points to opposite sides of the pedal housing 30. The fixing pin 32 includes a pair of fixing pins which are fitted into opposite sides of the hinge shaft 42 through the pedal housing 30. Each of the fixing pins has a slit end 33 towards the hinge shaft 42. Further, the separating plate 34 has inclined sides 34*a* that are fitted into the slit ends 33 of the fixing pins 32. Each of the turn plates 36 has opposite ends which are fitted through the separating plate 34 and the mounting bracket 20, respectively. Hence, the turn plates 36 are operated such that, when the pedal housing 30 is moved rearwards, the turn plates 36 turn about their hinge points to allow the inclined sides 34*a* of the separating plate 34 to press against the fixing pins 32.

The pedal housing 30 may be provided on its upper part with holes that communicate with the hinge shaft 42. Further, a hinge axis 37 is riveted to the side of the pedal housing 30. The mounting bracket 20 and the separating plate 34 are respectively provided with, for example, rectangular slits H through which opposite sides of the turn plates 36 are fitted. Here, the slit H may have a length slightly longer than the width of the turn plate 36 to facilitate a smooth turning motion of the turn plate 36.

The pair of fixing pins 32 are arranged such that the slit ends 33 thereof face each other. Each slit end 33 is slit in its diametric direction of a pin rod thereof, and the respective separating plate 34 is fitted into the corresponding slit end 33.

According to the configuration of the exemplary unit for preventing the inward shifting of the pedal arm as shown in FIGS. 4 and 5, when the engine and the pedal housing 30 are sequentially shifted towards the interior of a vehicle, the turn plates 36 may turn about their hinge axes 37 at the middle part thereof to allow the separating plates 34 coupled to the lower end of the corresponding turn plates 36 to press against the fixing pins 32. Here, since the inclined sides 34*a* of the separating plates 34 have been fitted into the slit ends 33 of the fixing pins 32, as the turn plates 36 turn, the inclined sides 34*a* of the separating plates 34 push the opposing fixing pins 32 away from each other, thereby decoupling them from the hinge shaft 42.

Accordingly, the fixing pins 32 which hinge-couple together the pedal housing 30 and the upper part of the pedal arm 40 are decoupled from the hinge shaft 42, so that the pedal arm 40 can no longer turn about hinge shaft 42. However, since the pedal arm 40 is also hinge-coupled at its middle part with the push rod 52 at a hinge point, the pedal arm 40 can still turn in the reverse direction (rearwards) about the hinge point with the push rod 52.

Figure 3:
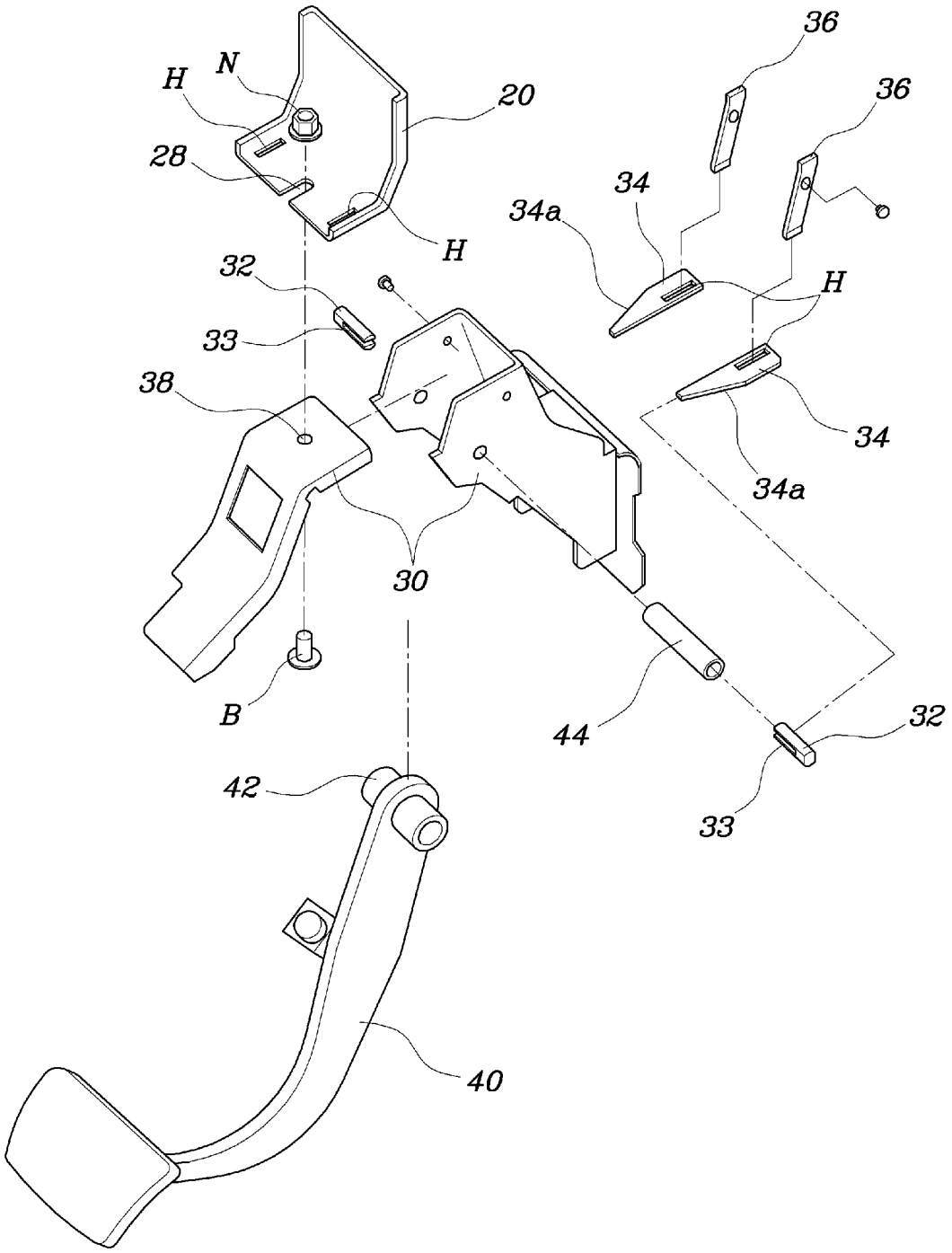
FIG. 3 is an exploded perspective view of FIG. 2.

As shown in FIGS. 3 to 5, an auxiliary hinge shaft 44 may be further disposed in the hinge shaft 42, wherein the fixing pins 32 are fitted into opposite sides of the auxiliary hinge shaft 44.

That is, since the auxiliary hinge shaft 44 is contained in the hinge shaft 42, the pedal arm 40 can turn smoothly, and the pedal arm 40 and the pedal housing 30 can be more firmly coupled to each other.

Figure 2:
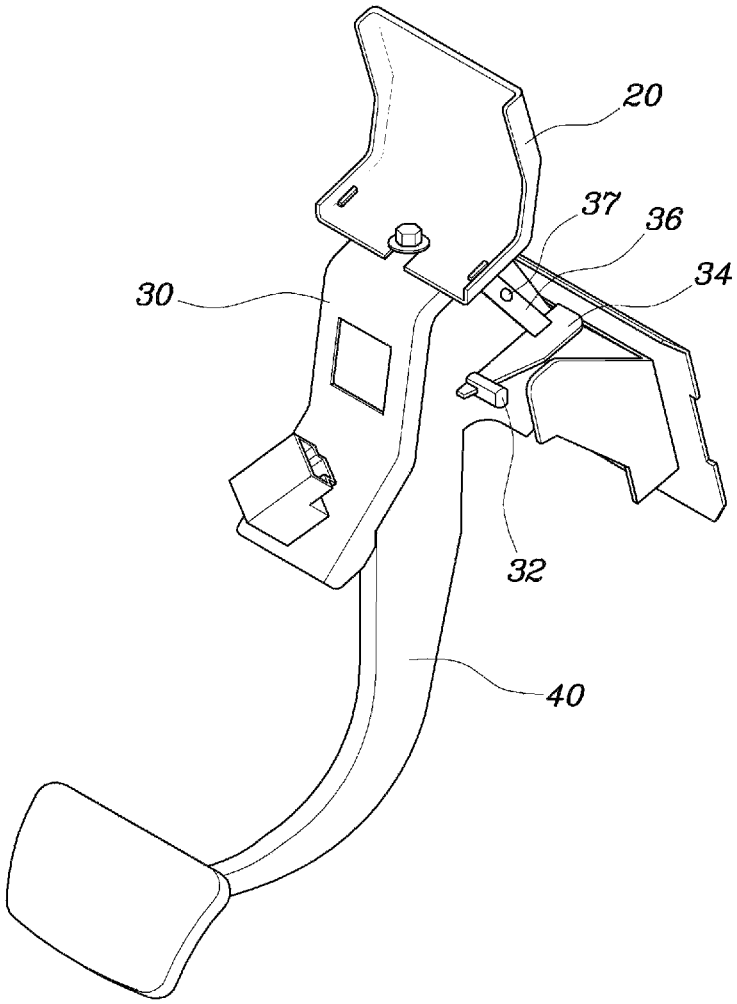
FIG. 2 is a perspective view of a device for preventing the inward shifting of a pedal according to an exemplary embodiment of the present disclosure.

As shown in FIGS. 2 and 3, the mounting bracket 20 may be provided at its lower end with a sliding hole 28, and the pedal housing 30 may be provided on its upper portion with a fixing hole 38 that corresponds to the sliding hole 28. A bolt B can be screwed into a nut N through the sliding hole 28 and the fixing hole 38.

When the pedal housing 30 is shifted inwards, the pedal housing 30 is moved towards the interior of a vehicle as the bolt B and the nut N fastening the mounting bracket 20 and the pedal housing 30 together slide along the sliding hole 28 towards the interior of the vehicle.

In the present disclosure, the pedal arm 40 hinge-coupled with the push rod 52 may be a pedal arm 40 provided to a brake pedal or a clutch pedal.

That is, the device of the present disclosure is applicable to the brake pedal or the clutch pedal. When the device is applied to the brake pedal, a push rod 52 may be connected to a brake booster 50, which in turn is connected to a master cylinder (not shown). Alternatively, when the device is applied to the clutch pedal, a push rod 52 may be connected to a clutch booster (not shown) or a clutch master cylinder (not shown).

Figure 6A:
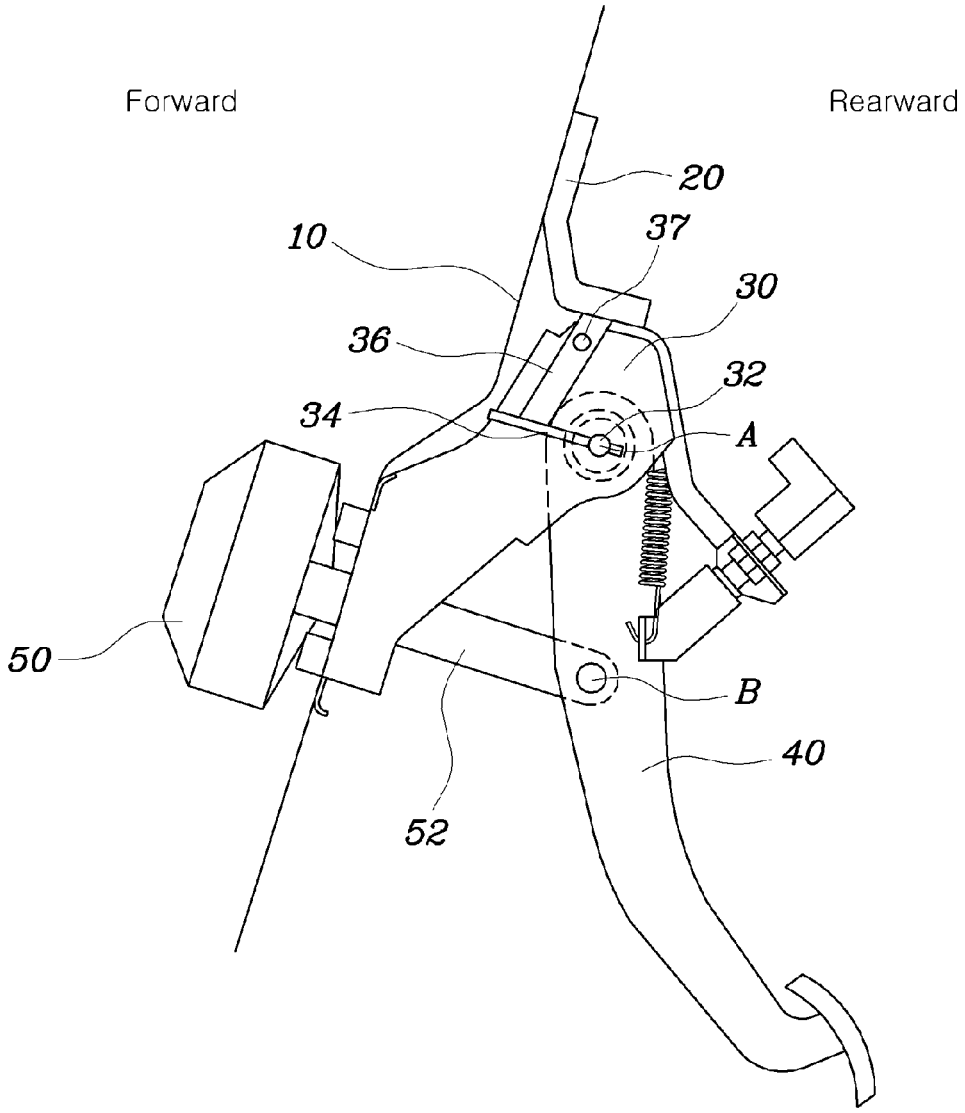
FIGS. 6A to 6C are views showing the sequential operations of the pedal arm in cooperation with the exemplary unit for preventing the inward shift of the pedal arm when a vehicle collision occurs.
Figure 6B:
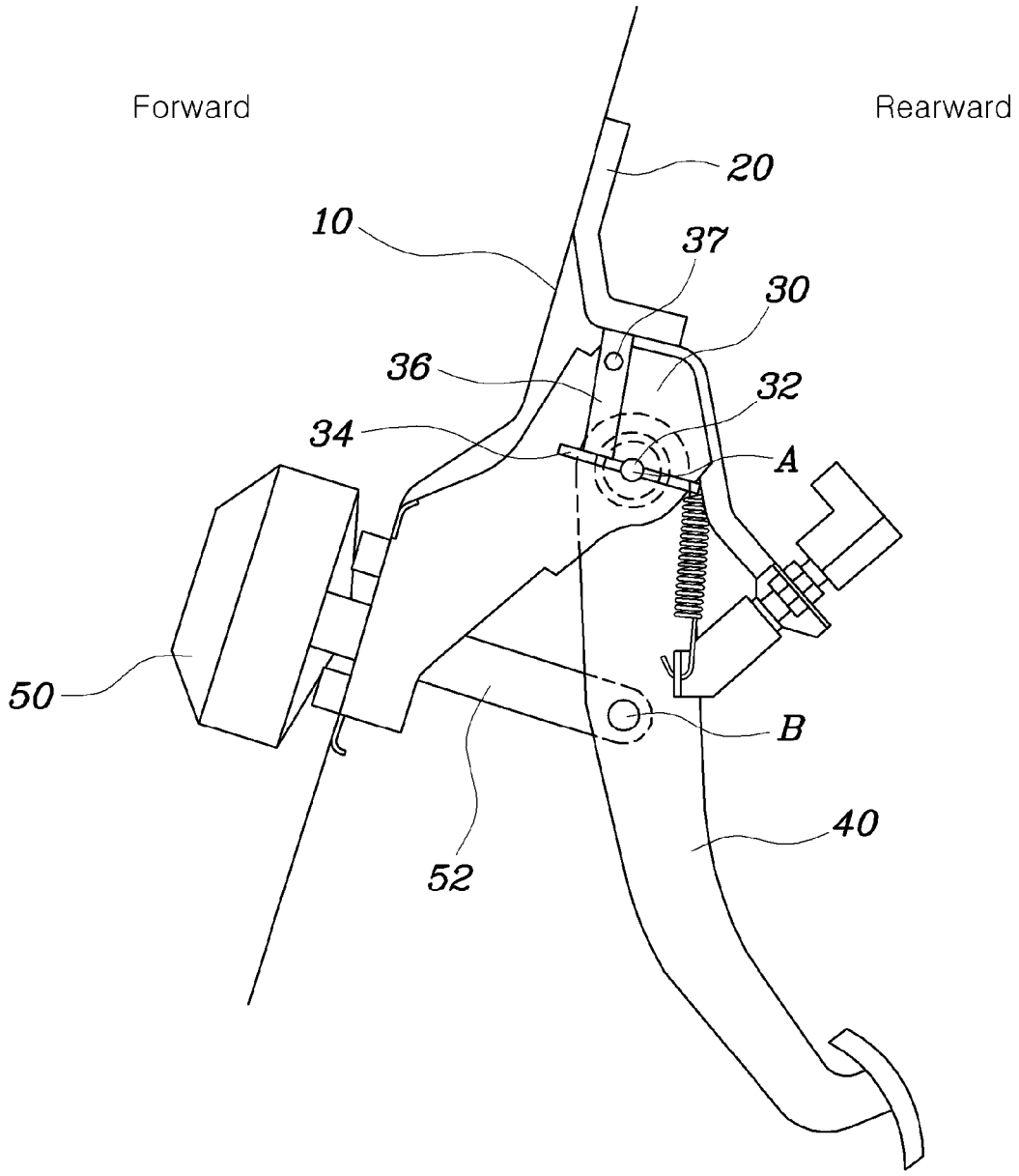
Figure 6C:
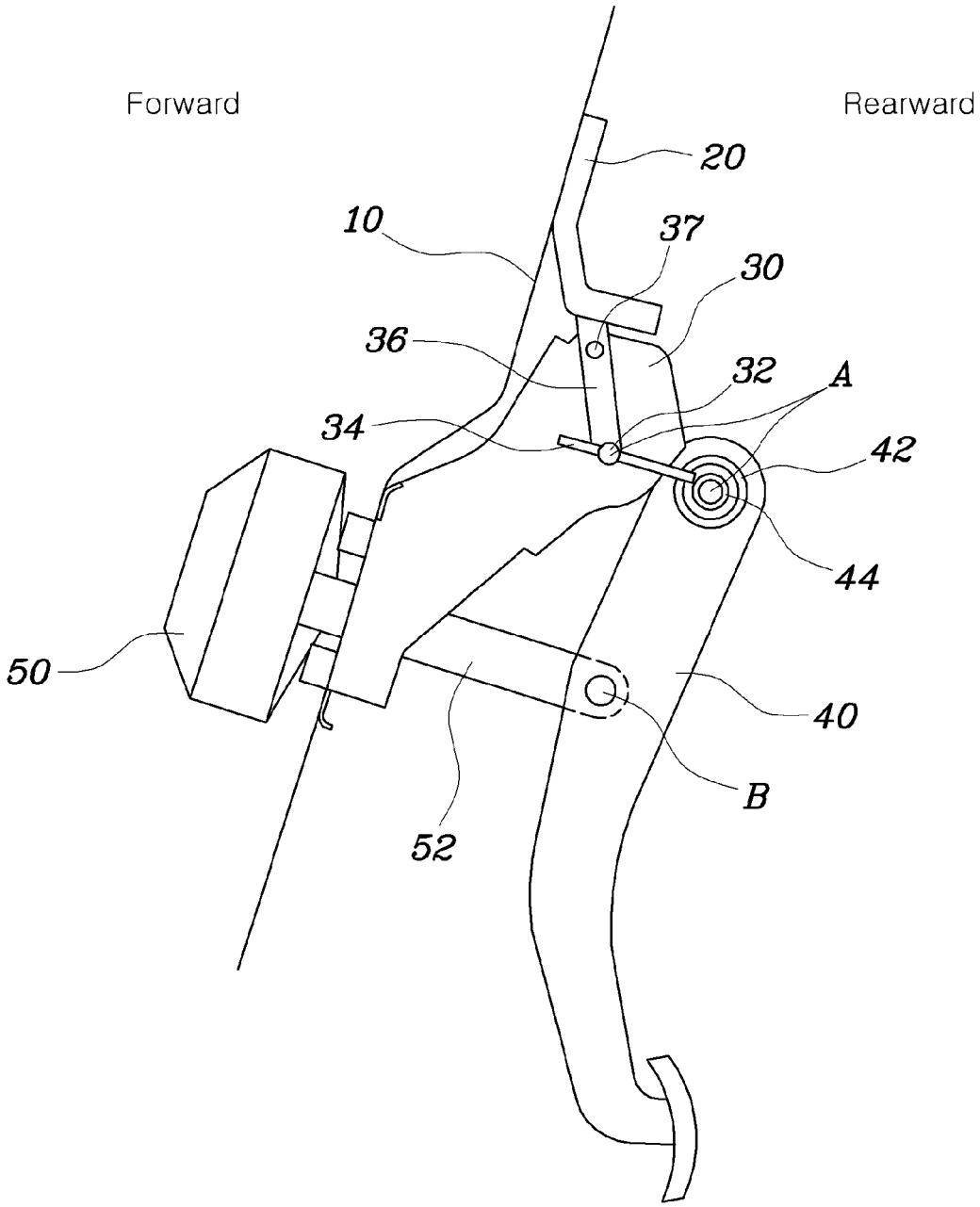

The operations and effects of the device for preventing the inward shifting of the pedal arm according to the present disclosure will be described with reference to FIGS. 6A to 6C, wherein an exemplary device is applied illustratively to a brake pedal.

When an engine is shifted towards the interior of a vehicle during a forward vehicle collision, the dash panel 10 may subsequently be moved towards the interior of the vehicle together with the brake booster 50.

Then, the bolt B and the nut N that fasten the pedal housing 30 and the mounting bracket 20 together slide along the sliding hole 28 towards the interior of the vehicle, together with the pedal housing 30, when the collision force exceeds the fastening force.

As the pedal housing 30 is shifted, the lower parts of the turn plates 36 turn towards the interior about the hinge axes 37 at their middle parts, with the upper parts thereof fitted into the pedal housing 30, and then push the corresponding separating plates 34, which are coupled to the respective lower parts of the corresponding turn plates 36, towards the interior of the vehicle. Since the inclined sides 34*a* of the separating plates 34 are fitted into the slit ends 33 of the fixing pins 32, the pushing motion of the separating plates 34 pushes the fixing pins 32 away from the hinge shaft 42, thereby decoupling the fixing pins 32 from the hinge shaft 42.

As a result, the pedal arm 40 and the pedal housing 30, which had been hinge-coupled by the fixing pins 32, are decoupled from each other, so that the pedal arm 40 can turn about the hinge point B at which an end of the push rod 52 of the brake booster 50 is hinge-coupled. Thereby, as the driver steps on the brake pedal, the pedal arm 40 turns outwards away from the driver, i.e., in a direction towards the engine at the front side of a vehicle.

Accordingly, when the brake pedal is shifted inwards by the inward shift of the engine during a forward vehicle collision, the pedal arm 40 that is hinge-pivoted about a hinge point A relative to the pedal housing 30 is decoupled from the hinge point A such that the pedal arm 40 is allowed to turn outwards, thereby having the effect of preventing or reducing the risk of a driver from sustaining injuries.

Further, the unit for preventing the inward shifting of the pedal arm may simply be mounted to the pedal housing 30 only at a position where it is hinge-coupled, thereby facilitating installation without having a significant impact upon a surrounding layout of a brake system, thereby being applicable to mass-production vehicles.

Furthermore, the unit may have a structure that is capable of minimizing the amount of inward shift of the pedal when the dash panel is shifted inwards during a vehicle collision, thereby contributing to an improvement in collision performance and therefore increasing the commercial value of a product.

Although a preferred embodiment of the present disclosure has been described for illustrative purposes, those having ordinary skill in the art will appreciate that various modifications, additions and substitutions are possible, without departing from the scope and spirit of the disclosure as described in the accompanying claims.

What is claimed is:

1. A device for preventing an inward shifting of a brake pedal during a collision, the device comprising:

a mounting bracket attached to an inside of a dash panel;

a pedal housing combined with the mounting bracket such that the pedal housing is movable rearwards from the mounting bracket;

a pedal arm having an upper part hinge-coupled with the pedal housing via a fixing pin, and a middle part hinge-coupled with a push rod at a hinge point, the pedal arm being configured to move the push rod back and forth while turning about the fixing pin; and a unit for preventing the inward shifting of the pedal arm, the unit having a separating plate fitted into the fixing pin and configured such that as the pedal housing is moved rearwards at the time of a vehicle collision, the separating plate presses against the fixing pin to decouple the fixing pin from the pedal arm, enabling the pedal arm to turn outwards about the hinge point at the middle part, wherein the unit for preventing the inward shifting of the pedal arm further comprises:

a hinge shaft attached to the upper part of the pedal arm, wherein the fixing pin includes a pair of fixing pins fitted into opposite sides of the hinge shaft through the pedal housing and each of the pair of fixing pins having a slit end towards the hinge shaft, wherein the separating plate includes a pair of separating plates each having an inclined side that is fitted into the slit end of a corresponding fixing pin; and a pair of turn plates rotatably hinge-coupled at respective hinge points to opposite sides of the pedal housing, each of the air of turn plates having opposite ends fitted through a corresponding one of the pair of separating plates and the mounting bracket, respectively, such that when the pedal housing is moved rearwards the air of turn slates turn about the respective hinge points to allow the inclined sides of the corresponding separating plates to press against the corresponding fixing pins.

2. The device according to claim 1, wherein an auxiliary hinge shaft is disposed in the hinge shaft, wherein the pair of fixing pins are fitted into opposite sides of the auxiliary hinge shaft.

3. The device according to claim 1, wherein the mounting bracket is provided at a lower end thereof with a sliding hole, and the pedal housing is provided on an upper portion thereof with a fixing hole corresponding to the sliding hole, wherein a bolt is screwed into a nut through the sliding hole and the fixing hole.

4. The device according to claim 1, wherein the pedal arm hinge-coupled with the push rod is a pedal arm provided to a brake pedal.

5. The device according to claim 1, wherein the pedal arm hinge-coupled with the push rod is a pedal arm provided to a clutch pedal.

* * * * *